United States Patent [19]

Cecil

[11] Patent Number: 5,030,389

[45] Date of Patent: Jul. 9, 1991

[54] PORTABLE COOLER APPARATUS

[76] Inventor: Wesley E. Cecil, 1108 W. Pine, Lompoc, Calif. 93436

[21] Appl. No.: 504,664

[22] Filed: Apr. 4, 1990

[51] Int. Cl.[5] ..... B01F 3/04

[52] U.S. Cl. ..... 261/29

[58] Field of Search ..... 261/29, DIG. 4

[56] References Cited

U.S. PATENT DOCUMENTS

| | | | |
|---|---|---|---|
| 1,016,157 | 1/1912 | Jost | 261/29 |
| 1,861,340 | 5/1932 | Fox | 261/29 |
| 2,262,772 | 11/1941 | Larsen | 261/29 |
| 2,769,620 | 11/1956 | Davison | 261/29 |
| 2,966,046 | 12/1960 | Wright | 261/29 |
| 2,998,714 | 9/1961 | Bonzer | 261/DIG. 4 |
| 4,333,887 | 6/1982 | Goettl | 261/29 |
| 4,798,060 | 1/1989 | Long et al. | 261/140.1 |
| 4,953,831 | 9/1990 | Albrecht | 261/DIG. 4 |

FOREIGN PATENT DOCUMENTS

| | | | |
|---|---|---|---|
| 7506266 | 2/1975 | Fed. Rep. of Germany | 261/29 |
| 3213666 | 10/1983 | Fed. Rep. of Germany | 261/29 |

*Primary Examiner*—Tim Miles

*Attorney, Agent, or Firm*—Leon Gilden

[57] ABSTRACT

An apparatus including an elongate container including a sealed lower chamber containing a pump, wherein the pump directs fluid upwardly through a "T" shaped conduit to an opposed pair of radiator pads, wherein the pads are adjacent a matrix of apertures in the side wall of the container, and wherein a lid mounted blower directs air through the water laden pads exteriorly thereof to effect a cooling of a surrounding environment.

6 Claims, 4 Drawing Sheets

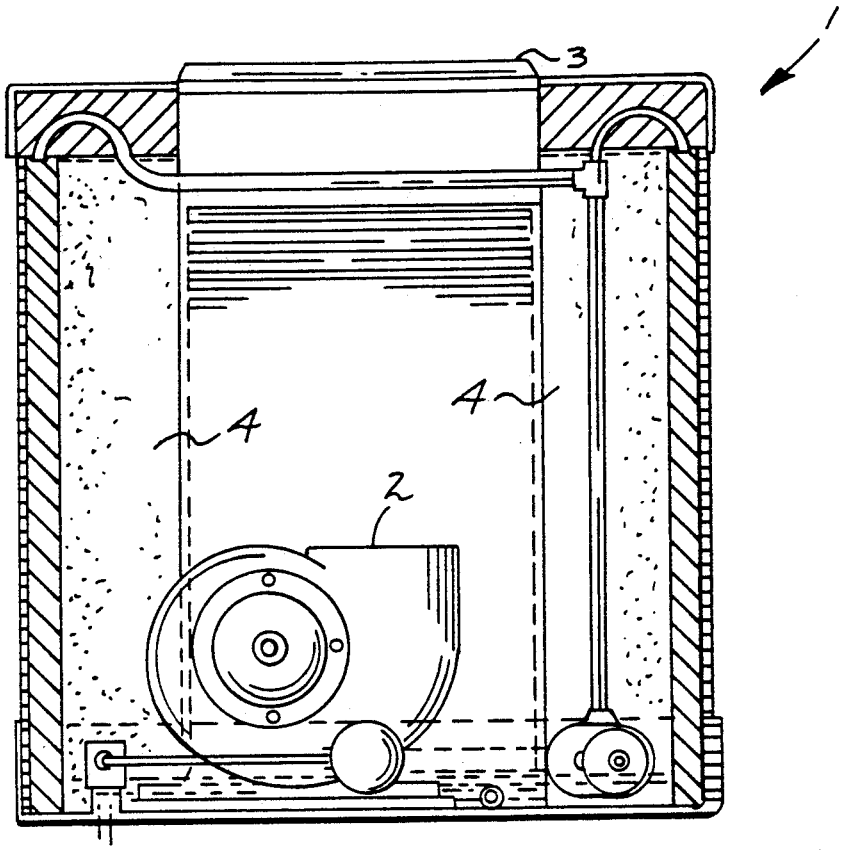
Fig 1
PRIOR ART
Fig 2
PRIOR ART
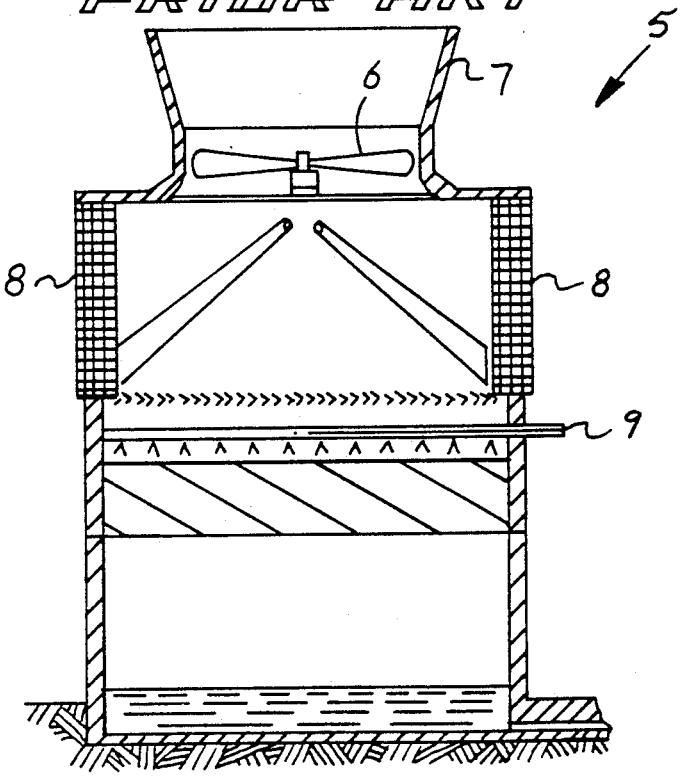

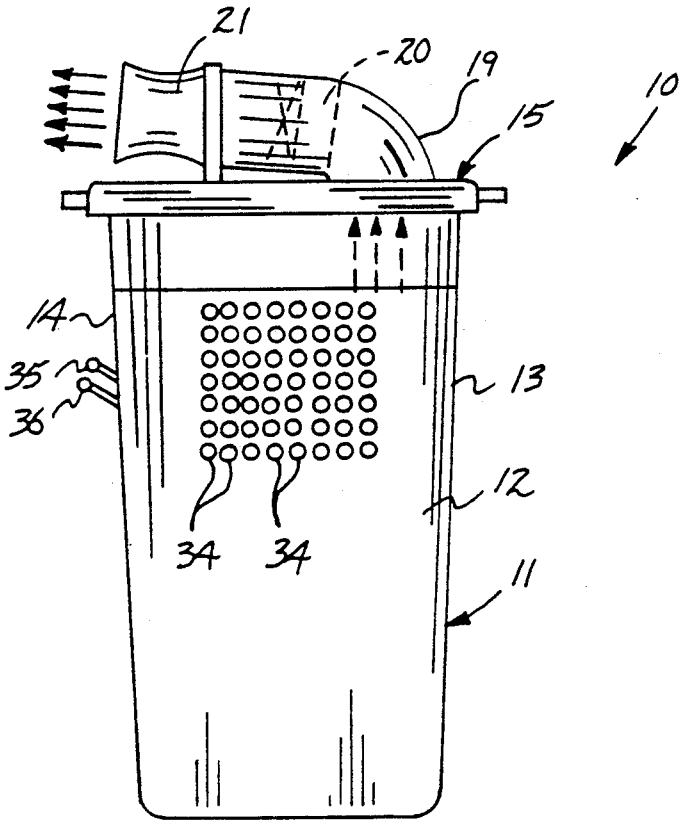
FIG 3
FIG 4
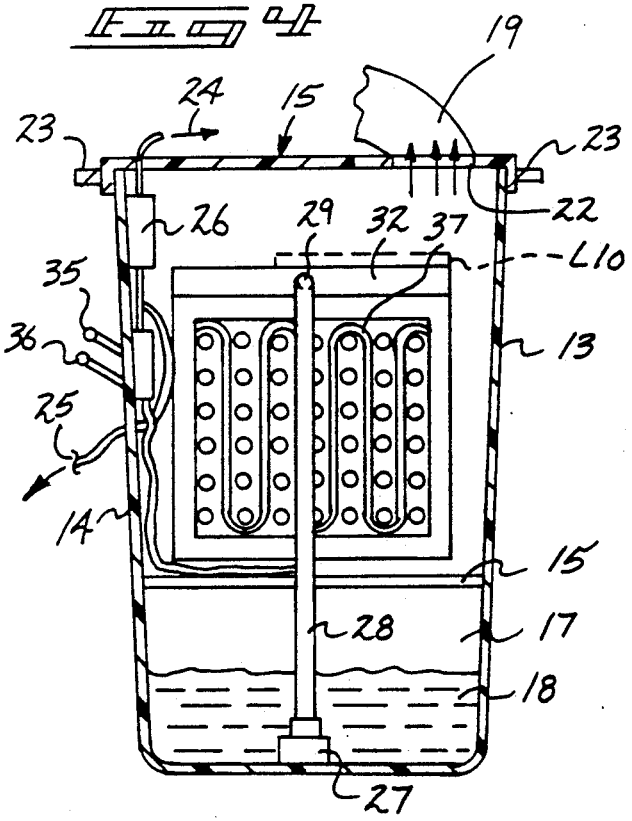

Fig 5
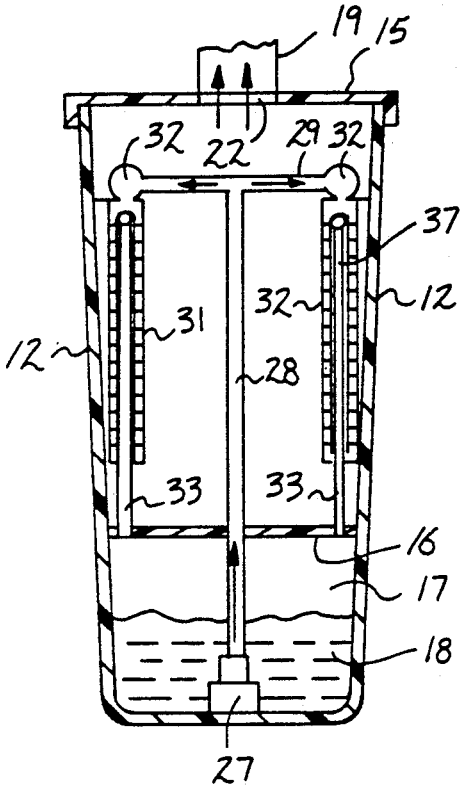
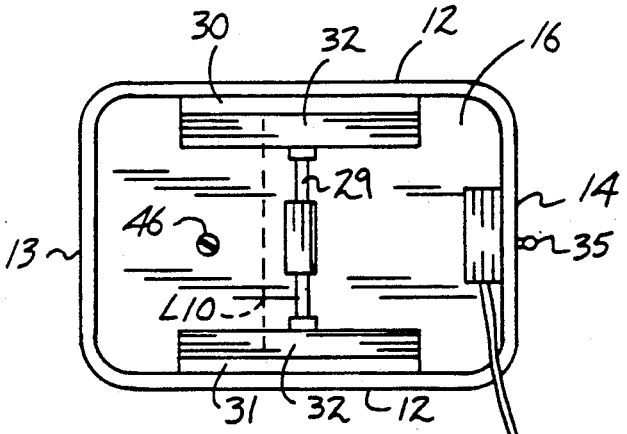
Fig 6

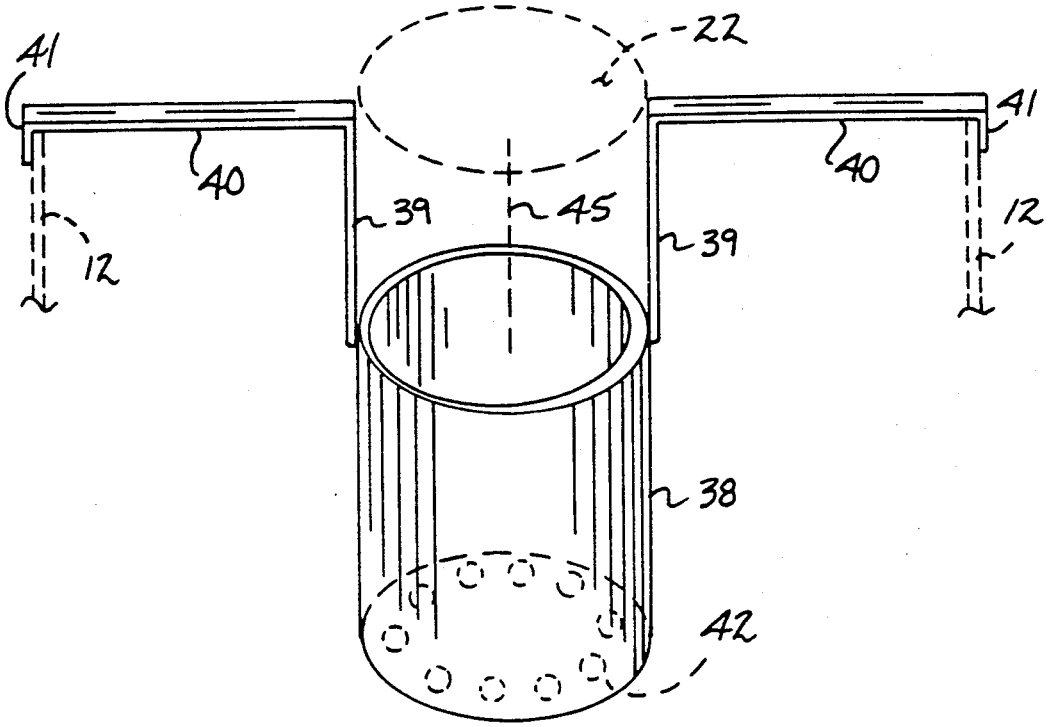
Fig 7
Fig 8
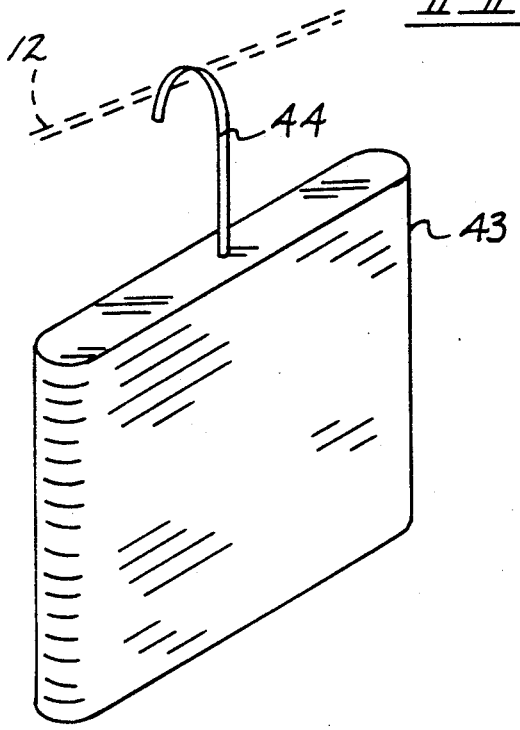

PORTABLE COOLER APPARATUS

BACKGROUND OF THE INVENTION

1. Field of the Invention

The field of the invention relates to portable cooler organizations, and more particularly pertains to a new and improved portable cooler apparatus wherein the same provides a convenient and compact unit to effect a cooling of a surrounding environment.

2. Description of the Prior Art

Cooling apparatus has heretofore been available in the prior art, but has been of a relatively elaborate and expansive construction providing a relatively costly and complex organization in use. The instant invention attempts to overcome deficiencies of the prior art by providing a convenient readily portable unitary housing provided with a spaced pair of cooling pads to effect cooling of a surrounding environment. Examples of the prior art include U.S. Pat. No. 4,367,183 to Carbonaro wherein directing channels are provided interiorly of a unit to direct air flow upwardly through a motor mounted to a top portion of the housing, with an underlying chamber to secure and direct moisture upwardly through the housing into the air stream directed by the blower motor.

U.S. Pat. No. 2,685,434 to Underwood provides a chamber with a surrounding pad member with fluid directed thereon, wherein the fluid is positioned in a bottom surface of the housing, wherein a fan mounted at a lowermost portion of the housing directs a moisturized air upwardly therethrough.

U.S. Pat. No. 3,833,052 to Cardinal provides for a subcontained air conditioning unit utilizing a conventional compressor, evaporator, and blower fan to effect a cooling procedure.

U.S. Pat. No. 3,169,575 to Engalitcheff, Jr., et al., wherein a refrigerant is directed through a coil with forced air directed upwardly past the coils to provide a cooling effect to a surrounding environment.

U.S. Pat. No. 2,998,504 to Morton, et al., provides a humidifier/dehumidifier organization enclosed within a single housing to illustrate the use of directed air flow therethrough to effect a selective humidifying or dehumidifying procedure.

As such, it may be appreciated that there is a continuing need for a new and improved portable cooler apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of cooler apparatus now present in the prior art, the present invention provides a portable cooler apparatus wherein the same provides for a self-contained cooler organization positionable and operative within selective environments to effect a cooling thereof. As such, the general purpose of the present invention, which will be described subsequently in greater detail, is to provide a new and improved portable cooler apparatus which has all the advantages of the prior art cooler apparatus and none of the disadvantages.

To attain this, the present invention provides an apparatus including an elongate container including a sealed lower chamber containing a pump, wherein the pump directs fluid upwardly through a "T" shaped conduit to an opposed pair of evaporative or fluid dispensing pads, wherein the pads are adjacent a matrix of apertures in the side wall of the container, and wherein a lid mounted blower directs air through the water laden pads exteriorly thereof to effect a cooling of a surrounding environment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable cooler apparatus which has all the advantages of the prior art cooler apparatus and none of the disadvantages.

It is another object of the present invention to provide a new and improved portable cooler apparatus which may be easily and efficiently manufactured and marketed.

It is a further object of the present invention to provide a new and improved portable cooler apparatus which is of a durable and reliable construction.

An even further object of the present invention is to provide a new and improved portable cooler apparatus which is susceptible of a low cost of manufacture with regard to both materials and labor, and which accordingly is then susceptible of low prices of sale to the consuming public, thereby making such portable cooler apparatus economically available to the buying public.

Still yet another object of the present invention is to provide a new and improved portable cooler apparatus which provides in the apparatuses and methods of the prior art some of the advantages thereof, while simultaneously overcoming some of the disadvantages normally associated therewith.

Still another object of the present invention is to provide a new and improved portable cooler apparatus providing an effective cooling of enclosed environments, as well as permitting relative access to internal portions of the apparatus for service and cleaning thereof to enhance a sanitary and effective use of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic cross-sectional view of a prior art portable cooler apparatus.

FIG. 2 is an orthographic cross-sectional view of a further prior art cooler organization.

FIG. 3 is an orthographic side view taken in elevation of the instant invention.

FIG. 4 is an orthographic cross-sectional side view taken in elevation of the instant invention.

FIG. 5 is an orthographic cross-sectional end view taken in elevation of the instant invention.

FIG. 6 is an orthographic top view taken in elevation of the instant invention underlying the lid thereof.

FIG. 7 is an isometric illustration of an accessory member utilized by the instant invention.

FIG. 8 is an isometric illustration of a further accessory member utilized by the instant invention.

DESCRIPTION OF THE PREFERRED EMBODIMENT

With reference now to the drawings, and in particular to FIGS. 1 to 8 thereof, a new and improved portable cooler apparatus embodying the principles and concepts of the present invention and generally designated by the reference numeral 10 will be described.

FIG. 1 is illustrative of a prior art cooler apparatus 1 wherein a louvered opening top 3 directs air from a blower motor 2 positioned at a lowermost portion of the container that draws air through moisturized pads 4 that are in a surrounding relationship relative to the associated container. FIG. 2 illustrates a further device 5 wherein a blower motor 6 directs air through a flared opening 7, directing such air through peripheral openings 8 that cooperate with a water distribution system 9 to impart moisture to the air flow directed through the opening 7.

More specifically, the portable cooler apparatus 10 of the instant invention essentially comprises an elongate longitudinally aligned container housing 11, including a floor and spaced side walls 12, and a first end wall 13 spaced from a second end wall 14. A removable lid 15 is securable to an upper open end of the housing to sealingly enclose the housing about the upper periphery of the housing defined by the walls 12, 13, and 14. A reservoir chamber 17 is oriented at a lowermost portion of the housing defined by a sealing plate 16 overlying the reservoir housing. The sealing plate 16 includes a plug member 46 (see FIG. 6 for example) to assist in replenishment of the reservoir as desired, that contains a quantity of water fluid 18 therewithin.

Mounted to the lid 15 is an "L" shaped exhaust conduit 19, including a blower motor 20 therewithin that directs pressurized air through a venturi 21 formed at a forwardmost end of the conduit 19. A conduit opening 22 of a predetermined diameter overlies the interior compartment of the housing 11, as illustrated in FIGS. 4 and 5 for example. Removal and replacement of the lid 15 is enhanced by use of handles 23 mounted to each end of the lid 15 to remove the lid and associated exhaust conduit 19 as a unit. A blower motor electrical connection 24 is directed from interiorly of the housing and is selectively securable to an associated battery container 26. Alternatively, an external power supply core 25 may use an external supply in lieu of the batteries 26 in a conventional manner to provide for alternative use of internal or an external power supply. A pump 27 is mounted to the upper surface of the floor of the housing 11, including a vertical conduit 28 directed upwardly therefrom, and is operative through a pump switch 36 as a blower motor switch 35 is also mounted therealong the second wall 14 to provide selective actuation of the blower motor 20 and the pump 27 respectively. The vertical conduit 28 bisects a horizontal pump conduit 29 and is in fluid communication therewith to direct fluid 18 through the vertical conduit 28 and then through each branch of the horizontal pump conduit 29, wherein this water is directed to opposed first and second fluid dispensing pads 30 and 31 mounted adjacent each side wall 12 of the housing. A feed conduit 32 overlies each dispensing pad 30 and 31 and is coextensive with an upper surface of each pad to direct water downwardly therethrough. In this manner, the pads 30 and 31 are saturated with the fluid with an excess of fluid directed through return conduits 33 through the sealing plate 16 to the underlying reservoir 17 therebelow to enable recirculation of such fluid. A matrix of intake apertures 34 is directed through each side wall 12 and is coextensive with and overlies each dispensing pad 30 and 31 to enable directing of air flow therethrough created by the exhausting of air through the "L" shaped conduit 19. Serpentine fluid distribution conduits 37 (see FIG. 4) are directed through each of the pads 30 and 31 and are in communication with the respective feed conduits 32 to enhance an even distribution of the fluid through the pads 30 and 31 such fluid distribution through the conduits 37 is effected in a conventional manner such as utilizing apertures and porosity through conduits 37 and the like. Air flow directed therefore through the venturi 21 effecting a cooling of the air flow directed through the various intake apertures 34 will provide a cooling effect to a surrounding environment to the organization 10.

Attention to FIGS. 7 and 8 illustrate the use of accessories to enhance the cooling effect of the organization, wherein a bucket 38 includes a pair of vertical, diametrically opposed support arms 39 integrally mounted orthogonally thereto to a pair of horizontal support arms 40 that terminate in downwardly depending leg members 41 that overlie the opposed side walls 12 of the housing 11. The bucket 38 is defined by an upper opening coaxially aligned by access 45 with the conduit opening 22 formed through the lid 15, as illustrated in FIG. 7. An apertured floor 42 contained within the floor of the bucket permits the use of "dry ice" and the like to be positioned within the bucket to enhance a refrigerating effect of air directed through the conduit 22. Further, freezeable gel packs 43 include hook members 44 to overlie the side walls 12 to further enhance a cooling within the housing 12 and thereby further cool the flow of air directed through the conduit 22 and associated exhaust conduit 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-contained portable cooler apparatus comprising, a solid elongate container having a lid removably mounted to an upper end thereof, the container including spaced first and second side walls and spaced first and second end walls, and a reservoir defining a lower compartment of the container having a plate member overlying the lower compartment containing water therewithin, and the plate member defining an upper compartment above the plate member, and a pump member mounted within the lower compartment including a vertical pump conduit directing water from the lower compartment to the upper compartment, and spaced water dispensing pads in fluid communication with said vertical pump conduit for receiving water therefrom, each of said water dispensing pads mounted within said housing adjacent a respective side wall of said first and second side walls, and openings through the side walls adjacent the dispensing pads, and an exhaust blower fan fixedly mounted to the lid to direct air to the dispensing pads and exteriorly of the upper compartment, and wherein the plate member is in sealing relationship relative to an interior surface of the side walls to sealingly separate the lower compartment from the upper compartment, and including a removable plug member to enable replenishment of fluid within the lower compartment, and wherein the second end wall includes a plurality of switch members to selectively actuate the pump member and the blower fan, and further including a self-contained battery supply within the upper compartment, and an external power supply to selectively utilize the battery supply or an external power supply.

2. An apparatus as set forth in claim 1 wherein the lid includes a conduit opening, and the exhaust blower fan is mounted within an exhaust conduit, wherein the exhaust conduit overlies the conduit opening.

3. An apparatus as set forth in claim 2 wherein the intake openings through the side walls define a first and second matrix of intake openings coextensive with and adjacent each respective spaced water dispensing pad to direct air flow therethrough, and each water dispensing pad includes a serpentine conduit directed therethrough in operative association with the pump conduit to direct fluid throughout each dispensing pad, and a feed conduit overlying and coextensive with an upper end of each dispensing pad, wherein each feed conduit is in fluid communication with the vertical pump conduit to receive water therefrom and direct the water through each of the serpentine conduits, and each dispensing pad including a return conduit operatively associated with each dispensing pad to direct excess water therefrom through the sealing plate into the underlying compartment defining the reservoir therebelow.

4. An apparatus as set forth in claim 3 wherein the exhaust conduit includes a venturi defined at a remote terminal end of the exhaust conduit spaced from the conduit opening of the lid.

5. An apparatus as set forth in claim 4 further including a bucket member coaxially aligned and underlying the conduit opening, the bucket member including spaced leg members, the leg members overlying opposed first and second side walls to coaxially align the bucket underlying the conduit opening, and the bucket including an apertured floor therethrough to direct air flow through the bucket, and the bucket positioned for enclosing a predetermined quantity of ice portions therewithin to enhance cooling through the exhaust conduit.

6. An apparatus as set forth in claim 5 further including freezeable gel packets, each packet including a hook member, each hook member oriented for overlying securement about an upper edge of each side wall and end wall to enhance cooling of the upper compartment.

* * * * *